US005573373A

United States Patent [19]

Olesen et al.

[11] Patent Number: 5,573,373

[45] Date of Patent: Nov. 12, 1996

[54] PROPELLAR HAVING OPTIMUM EFFICIENCY IN FORWARD AND REWARDED NAVIGATION

[75] Inventors: Steen C. Olesen, Fredericia; Sune Ehrenskjold, Kolding, both of Denmark

[73] Assignee: Gori marine as, Kolding, Denmark

[21] Appl. No.: 343,544

[22] PCT Filed: May 28, 1993

[86] PCT No.: PCT/DK93/00188

§ 371 Date: Feb. 9, 1995

§ 102(e) Date: Feb. 9, 1995

[87] PCT Pub. No.: WO93/24360

PCT Pub. Date: Sep. 12, 1993

[30] Foreign Application Priority Data

May 29, 1992 [DE] Germany ..... 0718/92

[51] Int. Cl.[6] ..... B63H 1/24

[52] U.S. Cl. ..... 416/131; 416/142

[58] Field of Search ..... 416/87, 88, 131 R, 416/140, 142, 240, 132

[56] References Cited

U.S. PATENT DOCUMENTS 2,532,371 12/1950 Petersen ..... 416/142

3,981,613 9/1976 Ehrenskjold et al. .

3,982,853 9/1976 Beck ..... 416/142

4,094,614 6/1978 Munk et al. .

FOREIGN PATENT DOCUMENTS 1403122 8/1975 United Kingdom ..... 416/142

*Primary Examiner*—James Larson

*Attorney, Agent, or Firm*—Jacobson, Price, Holman & Stern, PLLC

[57] ABSTRACT

A propeller in particular for a ship has blades each of which is pivotally arranged in the hub of the propeller so that the blade is capable of pivoting to and fro in an axial plane between forward and rearward positions. The blades are constructed such that each of the blade profiles formed as the intersecting face between a cylinder face coaxial with a propeller and a blade, is symmetrical in a position between forward and rearward positions which are determined by fixed stops in the hub and/or the simultaneous actions of the centrifugal force and the hydrodynamic pressure on the blade at a predetermined speed of rotation. This imparts a high efficiency and a quiet and steady operation to the propeller, when the ship navigates forwardly and rearwardly.

8 Claims, 4 Drawing Sheets

PROPELLAR HAVING OPTIMUM EFFICIENCY IN FORWARD AND REWARDED NAVIGATION

BACKGROUND OF THE INVENTION

1. FIELD OF THE INVENTION

The invention concerns a propeller in particular for a ship and having blades each of which is pivotally arranged in the hub of the propeller so that the blade is capable of pivoting to and fro in an axial plane between forward and rearward positions.

2. DESCRIPTION OF THE PRIOR ART

The energy which a propeller is capable of releasing when it is to propel a ship forwardly in the water depends upon the configuration of the propeller, in particular diameter, area, pitch and number of blades, in addition to the relative velocity of flow of the water and the actual number of revolutions of the propeller. The ratio of the energy released to the energy received by the propeller from the drive engine is called the efficiency of the propeller which is thus an expression of the ability of the propeller to utilize the added energy. When the ship is propelled by power the fuel consumption should be restricted to what is strictly necessary for economic and environmental reasons. Therefore, it will usually be attempted to design a propeller for a specific purpose such that it has an efficiency as high as possible under the given conditions of operation. One of the most important parameters included in the calculations in this context is the shape of the blade profiles formed as intersecting faces between the blades and cylinder faces which extend coaxially with the propeller. It is known that the intended good efficiency can be obtained by providing these blade profiles with a curved central line between their edges and having the convex side of this line facing the same way as the direction of navigation.

The typical direction of navigation will usually be forward, which is therefore generally chosen as the way which the convex side of the profile central lines is to face. Forward navigation can therefore take place with a good efficiency, which, on the other hand, is immediately transformed to an extremely poor efficiency when the ship is to be propelled rearwardly, because the curvature of the profile then faces the wrong way. In propellers having rigid blades the curvature and its direction are given once and for all when the propeller was manufactured, while the curvatures in propellers having pivotable blades are changed in response to the position of these.

U.S. Patent specification 3,981,613 discloses a folding propeller which is constructed particularly for improving the efficiency during rearward navigation. However, this is achieved merely by permitting the blades to pivot to positions which are located on both sides of a plane which contains the axis of rotation of the blades and is at right angles to the propeller axis.

It is common to the above-mentioned conventional propellers that their average efficiency in forward as well as rearward navigation is not satisfactory, and that the disadvantageous shape of the blades during rearward navigation is moreover the cause of strong propeller noise and vibrations which spread into the ship to the inconvenience of those on board.

Accordingly, there is a pronounced need for a new propeller structure whose total efficiency is optimum in forward and rearward navigation, and which, also in the latter situation, has blade profiles imparting a quiet and steady operation to the propeller.

SUMMARY OF THE INVENTION

The novel and unique features of the invention, by means of which this is achieved, are that the blades in a propeller having pivotal blades are constructed such that, in an area at least extending between the innermost and outermost end portions of the blade, each of the blade profiles, formed as the intersecting face between a cylinder face coaxial with the propeller and a blade, is substantially symmetrical about a straight line extending between the edges of the profile in a position between forward and rearward positions which are determined by fixed stops in the hub and/or by the simultaneous action of the centrifugal force and the hydrodynamic pressure on the blade at a predetermined speed of rotation. This changes the shape of the blade profile such that their curvature also has the convex side facing the same way as the direction of navigation during reverse movement.

In a particularly advantageous embodiment to ensure optimum efficiency the angular spacing of the position of symmetry from the propeller axis is determined by the fact that the cotangent to the angular spacing of the position of symmetry less the cotangent to the angular spacing of the rearward position divided by the cotangent to the angular spacing of the position of symmetry less the cotangent to the angular spacing of the forward position must numerically be of the same size as the proportion between the number of the operating hours of rearward and forward, respectively, navigation over a representative period.

The angular spacing of the position of symmetry from the propeller axis may advantageously be 90° when the propeller is used to the same extent in both directions, as is e.g. the case for bow propellers.

In many cases the blade profiles might be substantially symmetrical about a central line transversely to the profile. Then, the edges of the profile will usually be relatively sharp so that the blade cuts through the water in the same manner when the ship sails rearwardly as when it sails forwardly.

Alternatively, the blades may have asymmetrical blade profiles with a wing shape which, when the ship sails forwardly, has a relatively round leading edge and a relatively sharp trailing edge. This embodiment may be chosen advantageously when special importance is attached to the effect of the propeller during forward navigation, without this being at the expense of the good efficiency in rearward navigation.

BRIEF DESCRIPTION OF THE DRAWINGS

The invention will be explained more fully by the following description of embodiments, which just serve as examples, with reference to the drawing, in which FIG. 1 schematically shows a propeller having a blade intersected by a cylinder face to provide a blade profile, FIG. 2 schematically shows a propeller having a pivotable blade in three positions, FIGS. 3A, B and C show a first embodiment of a blade profile in the three positions shown in FIG. 2, FIGS. 4A, B and C show a second embodiment of a blade profile in the three positions shown in FIG. 2, FIGS. 5A, B and C show a third embodiment of a blade profile in the three positions shown in FIG. 2, but in a propeller structure in which the blades are rotated about their own axis while pivoting to and fro.

DESCRIPTION OF THE PREFERRED EMBODIMENTS

Figure 1:
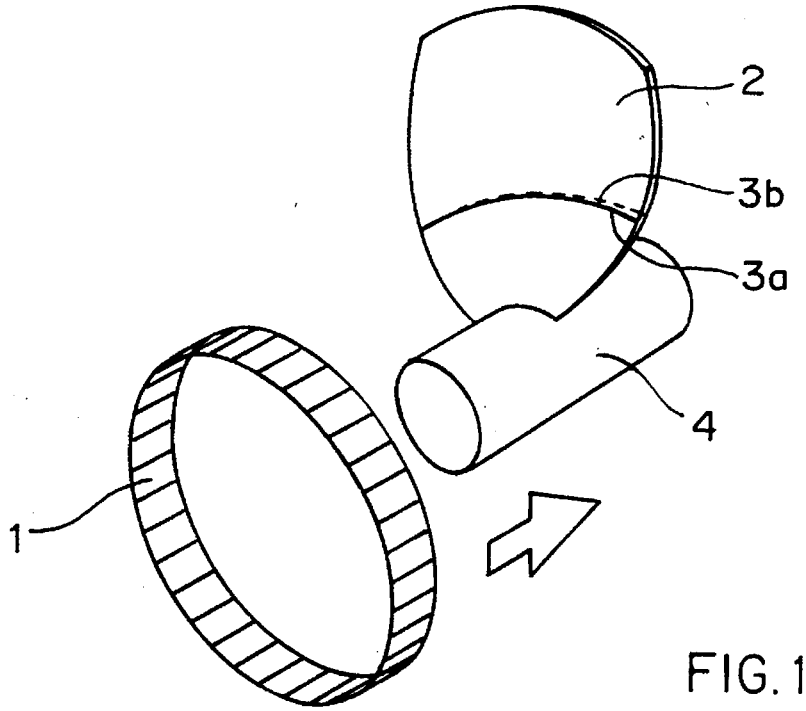

The water surrounding a propeller in operation may in practice be considered to be incompressible. The water will therfore flow past on both sides of the blade along intersecting curves between the blade and cylinder faces having the same axis as the propeller. This phenomenon is indicated in FIG. 1, in which the cylinder face is designated by the reference numeral 1, the propeller blade by the reference numeral 2 and the intersecting curves between the blade and the cylinder face by the reference numerals 3*a* and 3*b*. The blade is secured to a schematically shown hub 4, which usually mounts at least two blades. As will be seen, the intersecting curves 3*a*, 3*b* define a blade profile that may be regarded as the active profile of the propeller, and which, in a propeller having pivotable blades, will change its shape in response to the position assumed by the blade at a given moment.

When the water flows to the propeller during its rotation in the direction shown by the arrow in FIG. 1, a negative pressure is created on the front side of the propeller and a positive pressure on its rear side. The axial component of the resulting pressure constitutes the drive pressure of the blade, so that the drive pressure of the propeller will be the drive pressure of the individual blade multiplied by the number of blades which the propeller in question has. Usually, it is attempted to design a propeller blade such that with given dimensions it obtains the greatest possible drive pressure with the least possible water resistance. These factors greatly depend on the inclined position of the profile chord with respect to the relative velocity of flow of the water, i.e. upon the pitch, as well as the shape of the active profile. If this is curved, a strong negative pressure will be created on the more curved, or convex side and a smaller positive pressure on the other side, as is generally known. When constructing the blades with active profiles which are curved, a given propeller can therefore have an advantageously big drive pressure in the direction which the curvature of the propeller points.

Figure 2:
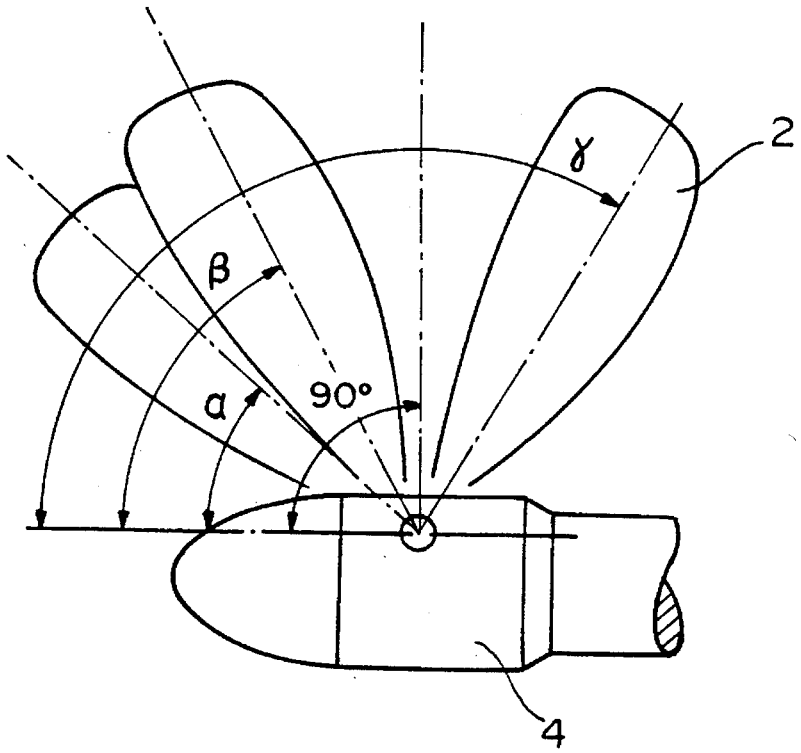

FIG. 2 shows a folding propeller of the type which is described in U.S. Patrnt specification 3,981,613. This propeller type is unique in that the blades can pivot from a folded position to a position having a greater angular distance from the propeller axis than 90°. This structure entails that the propeller can have a relatively good efficiency also in rearward navigation.

During a representative period, e.g. a calendar year, a ship will navigate rearwardly for a specific number of hours $h_1$ and navigate forwardly for another number of hours $h_2$. Navigation in both directions can take place at different propeller speeds either by changing the number of revolutions of the engine or by gearing the engine. However, in practice the speeds of rotation will be grouped around typical speeds or predominant speeds which the crew of the ship find expedient. These predominant speeds of rotation therefore form the basis for the subsequent considerations.

Figure 3A:
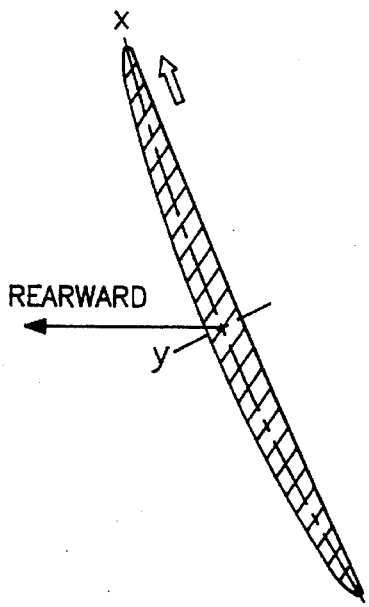
Figure 3B:
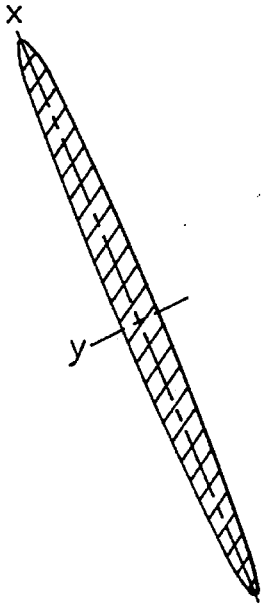
Figure 3C:
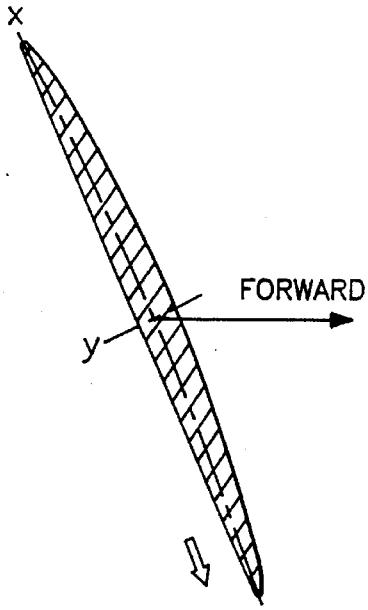

In the folding propeller shown in FIG. 2 the angular position of the blade with the propeller axis at the predominant reverse speed is indicated by $\alpha$ and the predominant forward speed by $\gamma$. A further blade position is shown between these two positions in which the blade has an angular distance $\beta$ from the propeller axis. A representative active blade profile in a first embodiment is shown in FIGS. 3A, B and C in the three positions shown in FIG. 2. The profile has a central line X extending from edge to edge and a transverse central line Y which is perpendicular to the central line X. In FIG. 3B the active profile is symmetrical about the central line X. This position is therefore called the position of symmetry of the blade. When the blade pivots from this to the reverse position shown in FIG. 3A, the profile will curve with the convex side pointing the same way as the ship navigates rearwardly. If, on the other hand, the blade is pivoted to the predominant forward position shown in FIG. 3C, the blade will curve in the opposite direction, viz. with the convex side now pointing the same way as the ship sails forwardly. No matter whether the ship thus sails forwardly or rearwardly, the active profile will therefore have an advantageous curved shape which, in both cases, has the convex side in the direction in which the ship sails at the time in question. Contrary to conventional propellers, the propeller of the invention has a good efficiency also when the ship navigates rearwardly, and blade profiles causing the propellers to operate quietly and steadily.

Utilizing the geometry prevailing when the blades of the propeller in the various pivoted positions are intersected by coaxial cylinder faces, an optimum efficiency can be obtained when choosing for the position of symmetry an angular distance $\beta$ which satisfies the equation $$\frac{|\cot\beta - \cot\alpha|}{|\cot\beta - \cot\gamma|} = \frac{h_1}{h_2}$$

in which the designations are as stated above. This entails not only that the active profiles of the blades will be curved in the right way in both directions of navigations, but also that the time of the navigation will be included for determining the position of symmetry in a balanced manner at such an angular distance that the overall efficiency through e.g. a calendar year will be as great as possible.

Figure 4A:
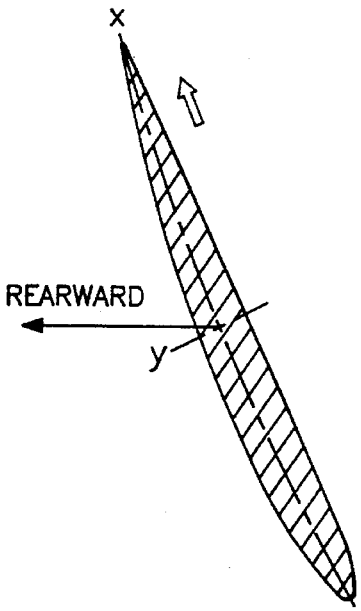
Figure 4B:
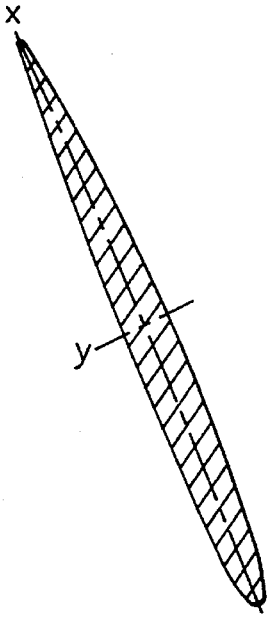

In FIGS. 3A, B and C the active profile is also symmetrical about the transverse central line Y, and it has relatively sharp edges at both ends. The blades will therefore act in the same manner, when they cut through the water, no matter whether the ship sails forwardly or rearwardly. This is not quite the case in the second embodiment shown in FIGS. 4A, B and C, which is asymmetrical about the central transverse line Y. In the position of symmetry shown in FIG. 4B the active profile is almost drop-shaped having a sharp edge in the rearward direction and relatively round edge in the forward direction. This provides extremely good flow conditions around the blades when the ship sails forwardly. However, as shown in FIG. 4A, the active profile curves advantageously in this case too in the direction of navigation when the ship navigates rearwardly.

Figures 5A, 5B, 5C:
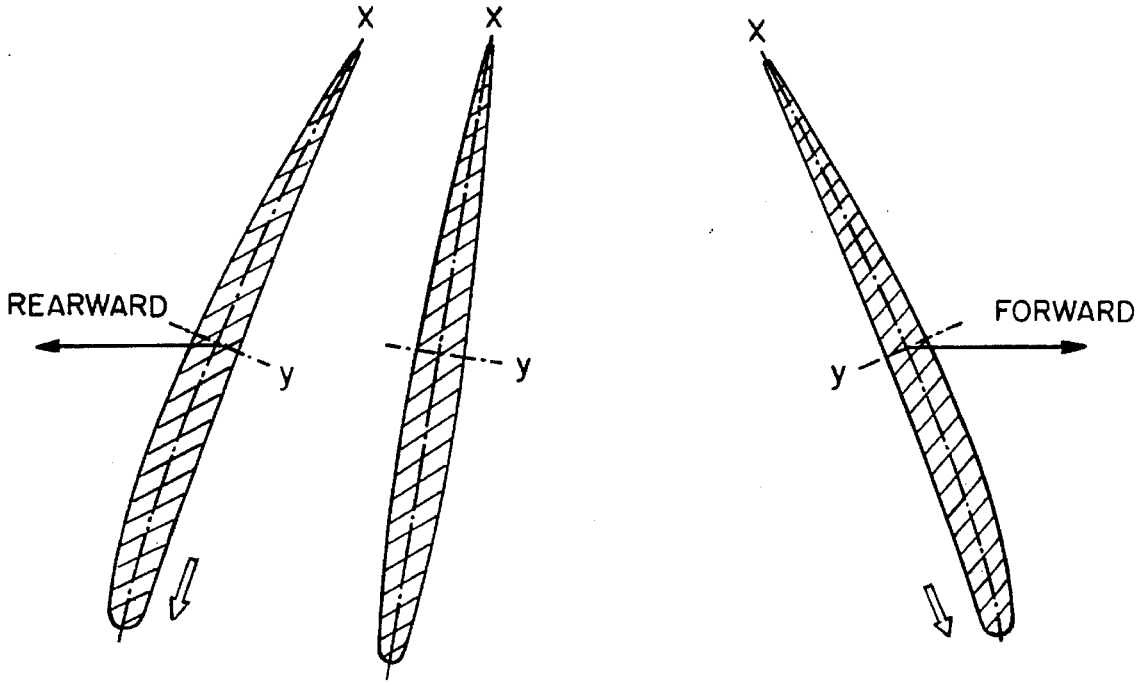

In the third embodiment shown in FIGS. 5A, B and C the propeller rotates the same way no matter whether the ship navigates forwardly or rearwardly, since the blades merely rotate about their own axis when the direction of navigation is to be changed. Therefore, the active profile can have an advantageous drop shape also for rearward navigation.

Figure 4C:
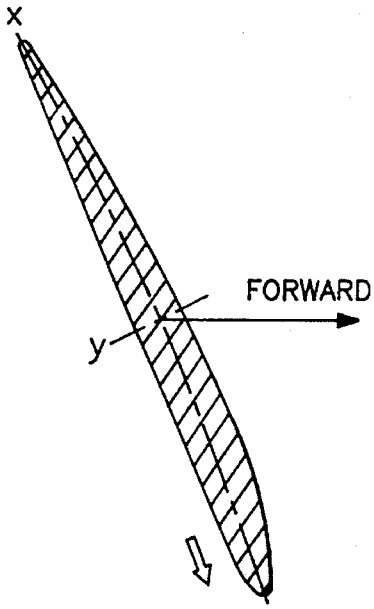
Figure 6:
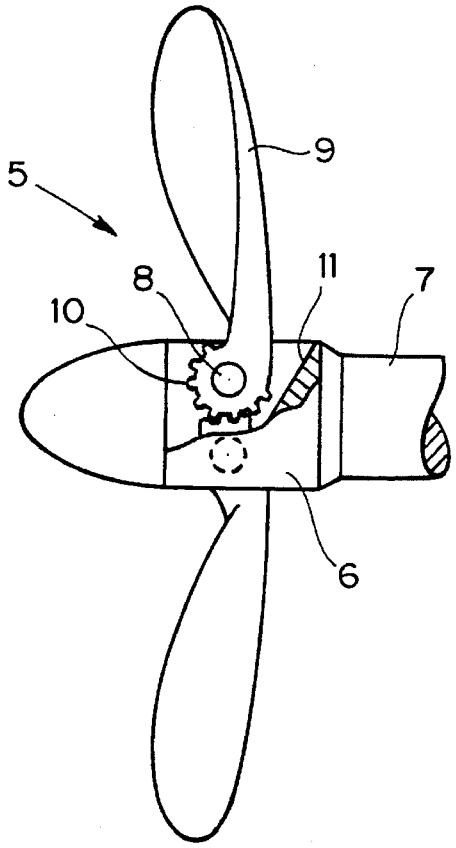
FIG. 6 is a lateral, partially sectional view of a folding propeller having two blades.

FIG. 6 shows a typical folding propeller which is generally designated 5. The propeller has a hub 6 which is mounted on the shaft 7 of a ship, of which only a fragment of the outermost end is visible. Two pivot pins 8 are arranged in the hub, and each of these pivotally mounts a blade 9. Each of these blades has a tooth segment 10 at the innermost end which engages the tooth segment 10 of the opposite blade to synchronize the pivotal movements of the blades. In the case shown, the hub 4 moreover has a fixed stop in the form of an abutment 11 against which the blade rests when it is present in the prevailing forward position. The prevailing rearward position is the position in which the blade is in equilibrium owing to the simultaneous action of the centrifugal force and the hydrodynamic pressure when the propeller rotates at the prevailing speed of rotation. It is noted that the embodiment of the folding propeller shown in FIGS. 4 and 6 just serves as an example. The prevailing positions may either be the positions in which the blades are in equilibrium owing to the simultaneous actions of the centrifugal force and the hydrodynamic pressure, or the positions may merely be determined by means of fixed stops in the hub, or be a combination of the two methods.

Figure 8:
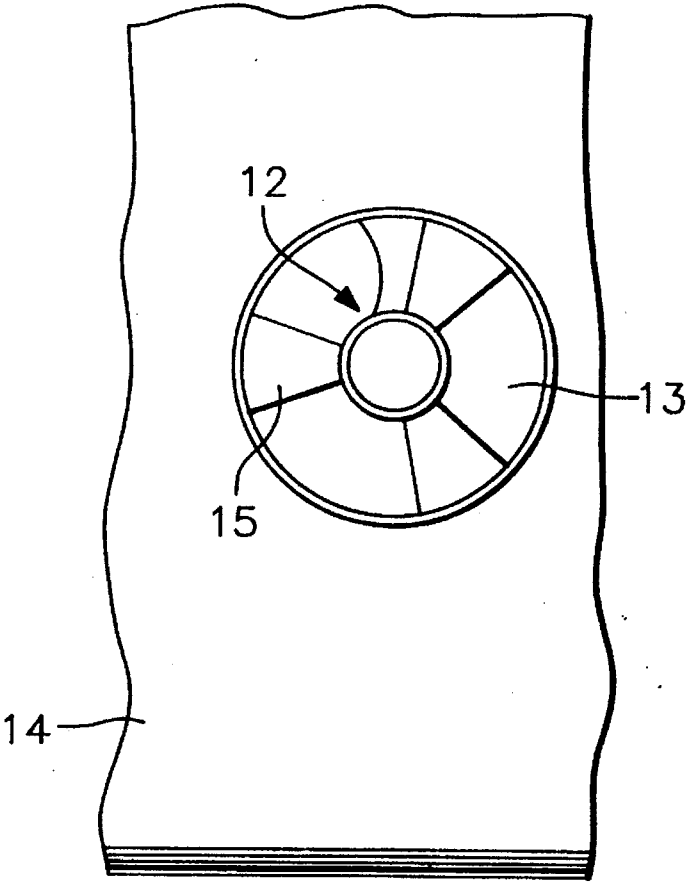
FIG. 8 is an end view of the same.
Figure 7:
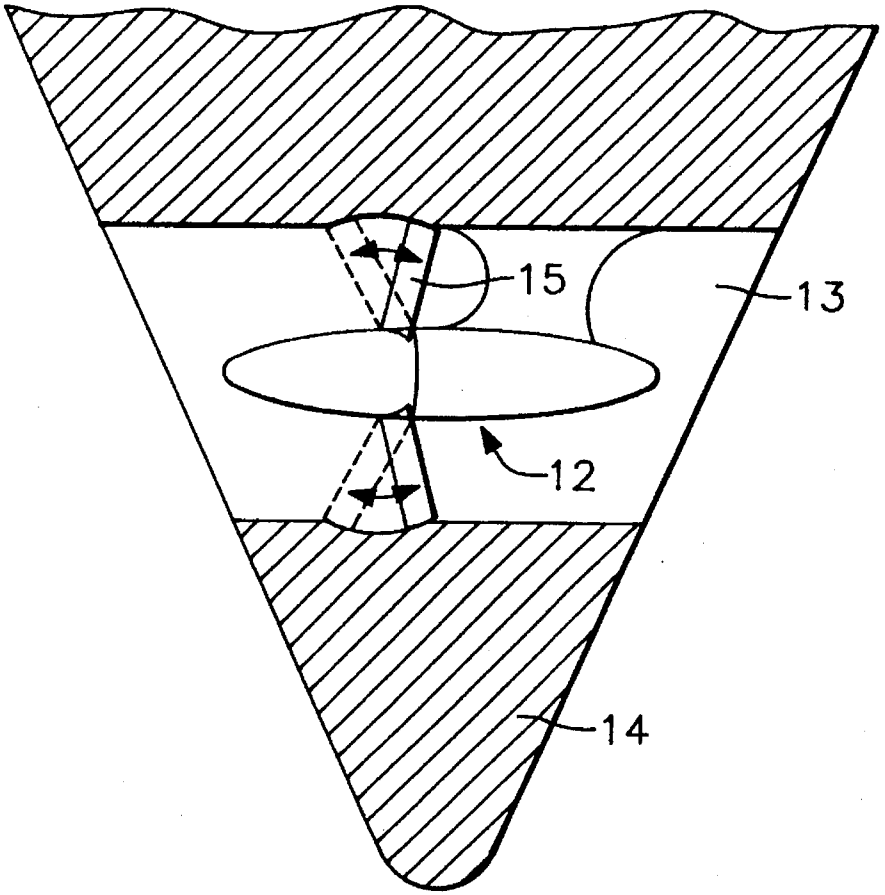
FIG. 7 is a lateral view of a bow propeller.

In many cases it is not desirable that the propeller is capable of being folded together completely. In that case, the blades can merely pivot through a certain angle about 90° between the two fixed stops in the hub. This is e.g. the case with the bow propeller 12 shown in FIGS. 7 and 8, which operates in a tunnel 13 provided transversely through the ship 14. The blades 15 of the bow propeller just need to be able to pivot through a minor angle about a position in which the angular distance from the propeller axis is 90° and the blade profiles are symmetrical about a straight longitudinal central line. The blades can therefore advantageously be constructed with active profiles which are curved to exactly the same extent in the operating directions of the bow propeller 12.

The invention is described above and shown in the drawing on the assumption that the propeller is to be used for a ship. However, it is contemplated that the structure of the invention can also be used for many other purposes within the scope of the invention, e.g. axial ventilators or axial turbines and stirring equipment.

We claim:

1. A propeller for a ship, said propeller having a hub, blades mounted on the hub of the propeller, pivot means connecting the blades to the hub to enable the blades to pivot to and fro in an axial plane between forward and rearward positions characterized in that the blades are designed such that, in an area extending at least between innermost and outermost end parts of the blade, each of the blade profiles, formed as the intersecting face between a cylinder face coaxial with the propeller and a blade, being substantially symmetrical about a straight line extending between edges of the profile in a position between said forward and rearward positions, each of the blade profiles, formed as the intersecting face between a cylinder face coaxial with the propeller and a blade, having a convex surface facing the direction of movement of the ship when the blades are pivoted to forward and rearward positions on opposite sides of the position of the blades when the blade profile is substantially symmetrical.

2. A propeller according to claim 1, characterized in that each blade profile is substantially symmetrical about a straight line between the edges of the profile when the blade has an angular distance β with respect to the propeller axis satisfying the equation $$\frac{|\cot\beta - \cot\alpha|}{|\cot\beta - \cot\gamma|} = \frac{h_1}{h_2}$$

in which α and γ are the angular distance of the blade from the propeller axis at rearward and forward, respectively, navigation when the blade is in a position of equilibrium and $h_1$ and $h_2$ are the number of operating hours of rearward and forward, respectively, navigation over a cyclically recurring period.

3. A propeller according to claim 1, characterized in that each blade profile is substantially symmetrical about a straight line between edges of the profile at an angular position of 90°.

4. A propeller according to claim 1, characterized in that each blade profile is substantially symmetrical about a central line transversely to the profile.

5. A propeller according to claim 1, characterized in that each blade profile is symmetrical about a central line transversely to the profile.

6. A propeller according to claim 5, characterized in that each blade profile has a relatively sharp edge in the rearward direction and a relatively round edge in the forward direction.

7. The propeller according to claim 1 wherein said forward and rearward positions of said propeller blades are determined by stops on the hub.

8. The propeller according to claim 1 wherein said forward and rearward positions of the propeller blades are positions of equilibrium caused by simultaneous actions of centrifugal force and hydrodynamic pressure at a predetermined speed of rotation of the propeller.

* * * * *

UNITED STATES PATENT AND TRADEMARK OFFICE

CERTIFICATE OF CORRECTION

PATENT NO. : 5,573,373

DATED : November 12, 1996

INVENTOR(S) : OLESEN et al

It is certified that error appears in the above-identified patent and that said Letters Patent is hereby corrected as shown below:

On title page, item [54] and col. 1, lines 1-3, title of invention should read as follows:

PROPELLER HAVING OPTIMUM EFFICIENCY IN FORWARD AND REARWARD NAVIGATION

[30] Foreign Application Priority Data

May 29, 1992 [DK] Denmark ..... 0718/92

Signed and Sealed this

Fifteenth Day of July, 1997

Bruce Lehman

*Attest:*

BRUCE LEHMAN

*Attesting Officer*

*Commissioner of Patents and Trademarks*